United States Patent [19]

Bodewein

[11] Patent Number: 4,799,847

[45] Date of Patent: Jan. 24, 1989

[54] SHEET STACKER

[75] Inventor: Jakob Bodewein, Monchen-Gladbach, Fed. Rep. of Germany

[73] Assignee: Jagenberg Aktiengesellschaft, Dusseldorf, Fed. Rep. of Germany

[21] Appl. No.: 913,811

[22] Filed: Sep. 29, 1986

[30] Foreign Application Priority Data

Oct. 2, 1985 [DE] Fed. Rep. of Germany ..... 3535113

[51] Int. Cl.[4] ..... B65H 31/32

[52] U.S. Cl. ..... 414/790.8; 271/211

[58] Field of Search ..... 271/211, 309; 414/50

[56] References Cited

U.S. PATENT DOCUMENTS

| | | | |
|---|---|---|---|
| 2,205,767 | 6/1940 | Lamb . | |
| 3,150,578 | 9/1964 | Dale et al. | 414/50 X |
| 3,224,761 | 12/1965 | Meger-Jagenberg | 271/211 X |
| 3,231,100 | 1/1966 | Faeber | 414/46 X |
| 3,704,883 | 12/1972 | Don | 414/77 X |
| 4,162,649 | 7/1979 | Thornton | 414/50 |
| 4,270,908 | 6/1981 | Lehmacher | 414/50 X |
| 4,359,218 | 11/1982 | Karis | 414/907 X |
| 4,405,125 | 9/1983 | Kulpa et al. | 271/211 X |
| 4,561,645 | 12/1985 | Pollich | 271/211 X |
| 4,643,414 | 2/1987 | Weisgerber | 271/211 X |

FOREIGN PATENT DOCUMENTS

| | | |
|---|---|---|
| 1436511 | 12/1969 | Fed. Rep. of Germany . |
| 2942965 | 5/1981 | Fed. Rep. of Germany . |
| 2725267 | 5/1983 | Fed. Rep. of Germany . |
| 3122451 | 2/1985 | Fed. Rep. of Germany . |

*Primary Examiner*—Robert J. Spar
*Assistant Examiner*—Janice Krizek
*Attorney, Agent, or Firm*—Sprung Horn Kramer & Woods

[57] ABSTRACT

The invention relates to a sheet stacker for sheets in particular of thin material, such as paper. In order to be able to change the stack without reducing the conveying speed of the sheets conveyed in an overlapping manner and without wasting sheets, free spacers 18 are provided on the underside of the table plate 7 of the transfer table 3 between the conveyor belts 8 for its guide and conveying rollers 10–14 and its bearing blocks 16, which free spacers receive the bars 19 of a bar screen. The bars 19 of the bar screen are arranged above the upper level of the stack 46 and may be inserted in the open gusset between the sheets 1 conveyed in an overlapping manner an the stack 46. Additional separators, which only facilitate an insertion of the bars 19, are no longer necessary.

10 Claims, 4 Drawing Sheets

Fig. 3
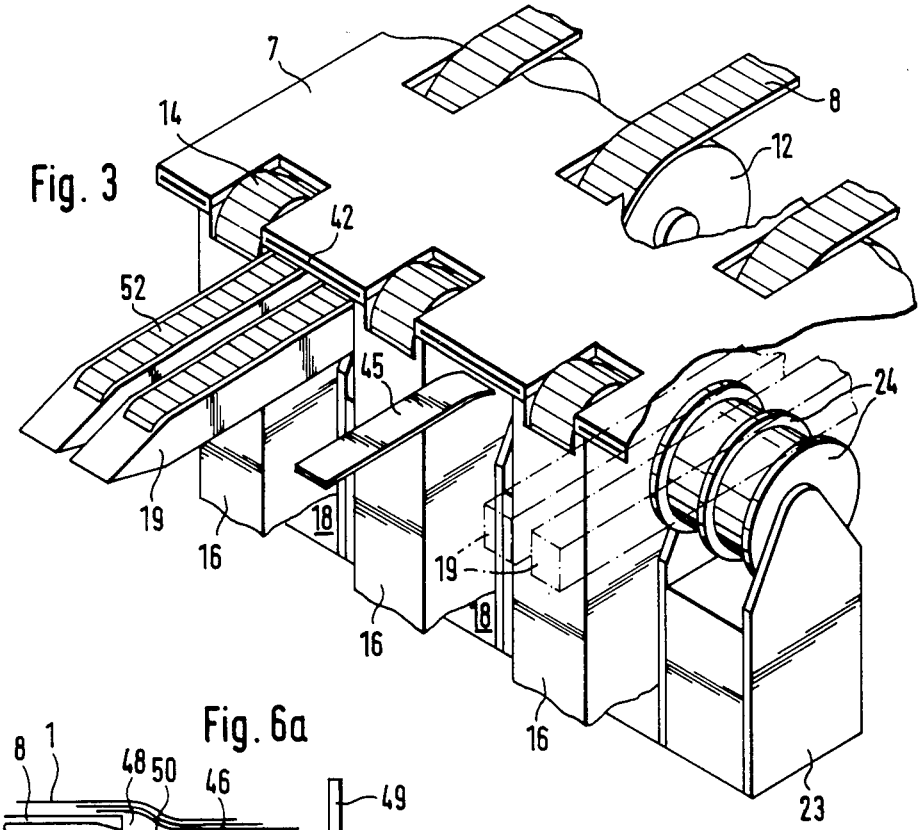
Fig. 6a
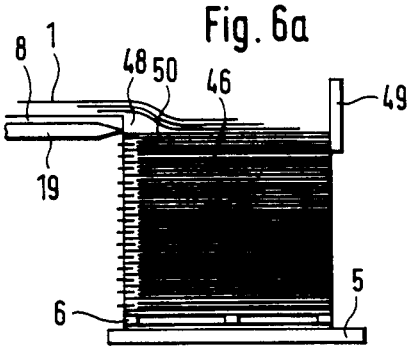
Fig. 6d
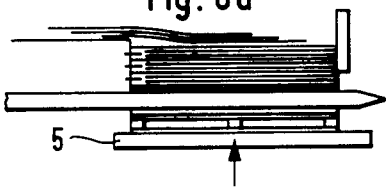
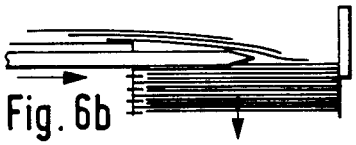
Fig. 6b
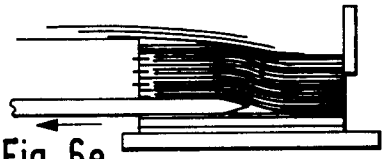
Fig. 6e
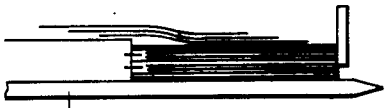
Fig. 6c
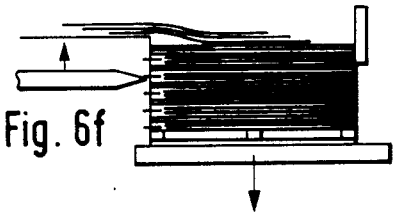
Fig. 6f

SHEET STACKER

The invention relates to a stacker for sheets conveyed in an overlapping manner, in particular of thin material such as paper, consisting of a transfer table comprising conveyor belts and/or conveying rollers, of a stacker table which can be lowered and of a bar screen able to be introduced above the stracker table in the conveying direction between the sheets which have been stacked and the conveyed sheets, in particular with sliding belts located on the upper side.

Various constructions of stackers for sheets conveyed in an overlapping manner are known. The users of such stackers require that the stack of sheets on the stacker table can be exchanged with as little disturbance as possible and with as little wastage as possible.

In a stacker for sheets of paper which are conveyed in an overlapping manner, for preparing for the change of a stack, the conveying speed of the sheets conveyed in an overlapping manner is reduced and by extracting sheets a gap is formed in the stream of overlapped sheets, in order to be able to slide a new stacking platform (palette) into the gap by means of an intermediate stacking device in the opposite direction to that in which the sheets are conveyed. With a stacker of this type, the requirement of changing stacks with little wastage is not fulfilled.

In another known stacker of the aforementioned type, the requirements of wastage-free changing of the stack is fulfilled without reducing the conveying speed. In this stacker, for changing the stack, a pointed separating member is inserted from the underside of the overlapping sheets and approximately in the conveying plane, between the rear edges of the two sheets between which the separation of the stack is to take place. This separating member prevents successive sheets from falling onto the upper side of the stack. During further conveyance it is lowered further, but only so much that the sheets conveyed in an overlapping manner can slide further one above the other. In this way a gap is produced between the lower stack and the upper sheets which are held in place, into which gap a bar screen can be introduced as an intermediate stacking device. This inserted bar screen then receives the sheets held back by the separating member and makes it possible to change the stack. The bar screen is lowered in accordance with the progress in the construction of the new stack. After a new palette is placed under the bar screen, the bar screen can be retracted and the intermediate stack laid thereon (German PS 31 22 451). A stacker of this type has a complicated construction on account of the necessary separating member.

It is the object of the invention to provide a sheet stacker of the afore-mentioned type, which without reducing the conveying speed allows the stack to be changed without wastage. The stacker is particularly suitable for thin sheet material, such as paper.

This object is achieved according to the invention due to the fact that on the underside between the conveyor belts and/or conveying rollers, the transfer table comprises free spacers reaching as far as the underside of the table plate, which free spacers receive the bars of the bar creeen located above the level of the upper side of the stack.

In the invention, the natural gusset which is open towards the transfer table and is located between the upper side of the stack and the underside of the overlapping stream of sheets is utilized for introducing the bar screen. This is made possible due to the special construction of the transfer table. Due to the elimination of special separating members, the expenditure necessary for exchanging the stack is substantially less than in the known sheet stacker.

According to one embodiment of the invention, the bars are located on a carriage which is able to travel in a guide which can be lowered. In particular the bars are mounted on the carriage so that they can be exchanged. This interchangability may preferably be realized due to the fact that each bar comprises a twin coupling part for selective positive coupling and holding on a holder provided in the guide or on the carriage.

If individual bars can be uncoupled from the carriage, this has the advantage that the active part of the bar screen can be coordinated with the sheet width and auxiliary means such as separating or vibrating plates for the stack can be located in the path of the missing bars.

Since an intermediate stack is formed in each case on the screen when the stack is changed, and unlike the afore-described stacker no gap is formed in the flow of sheets in order to be able to insert the new palette in the gap, on which the continuing formation of a stack takes place, the lateral separating and/or vibrating plates for the sheets and the stop for the front edge of the sheets can be located so that they are arranged with their lower edges below the level of the upper side of the bar screen in its uppermost position. This has the advantage that no sheets may migrate below the separating and vibrating plates and the stop, which is still possible in the case of the direct formation of a stack on a palette, above which the separating plates are located.

For reasons of stability it is favorable if a support which can be lowered together with the guide which can be lowered is provided on the opposite side of the stacking table from the transfer table for the free ends of the bars.

For the same reasons, the bars of the bar screen should be supported on support rollers which can be lowered, on the side of the guide table adjacent the stacking table.

For better separation of the individual sheets as they are laid on the stack, it is provided according to one embodiment of the invention that at its front edge between the conveyor belts and/or conveying rollers, the transfer table comprises blowing nozzles with a blowing direction pointing in the conveying direction of the sheets. Preferably the edge comprises further blowing nozzles with a blowing direction pointing obliquely downwards onto the upper side of the stack. The blowing air emerging in the conveying direction acts as a lubricant between the individual sheets, so that sliding of the individual sheets one over another is promoted. Also, due to the blowing of air, the introduction of the bar screen is facilitated. The blowing air directed onto the upper side of the stack accelerates the stacking of the sheets and thus also quickly produces gaps for introducing the bar screen. Whereas the blowing air blown in the conveying direction of the sheets should emerge continuously, the blowing air directed onto the stack of sheets should emerge in pulses and indeed whenever the rear edge of a sheet leaves the transfer table.

The free spacers created also make it possible to mark the stack in a new way. Thus a marking apparatus, in particular an interleaving apparatus for a separating strip may be located in a free space between the conveyor belts and/or conveying rollers.

The invention is described in detail hereafter with reference to the drawings illustrating one embodiment and in which:

FIG. 3 shows part of the front edge of the transfer table of the sheet stacker according to FIG. 1, in perspective view;

FIGS. 6*a*–6*f* show various stages of the exchange of the stack.

An overlapping station 2 shown solely by its conveyor belt 2*a*, a transfer table 3 and a sheet stacker 4 are illustrated one behind the other in the conveying direction of the overlapping sheets 1.

Figure 1:
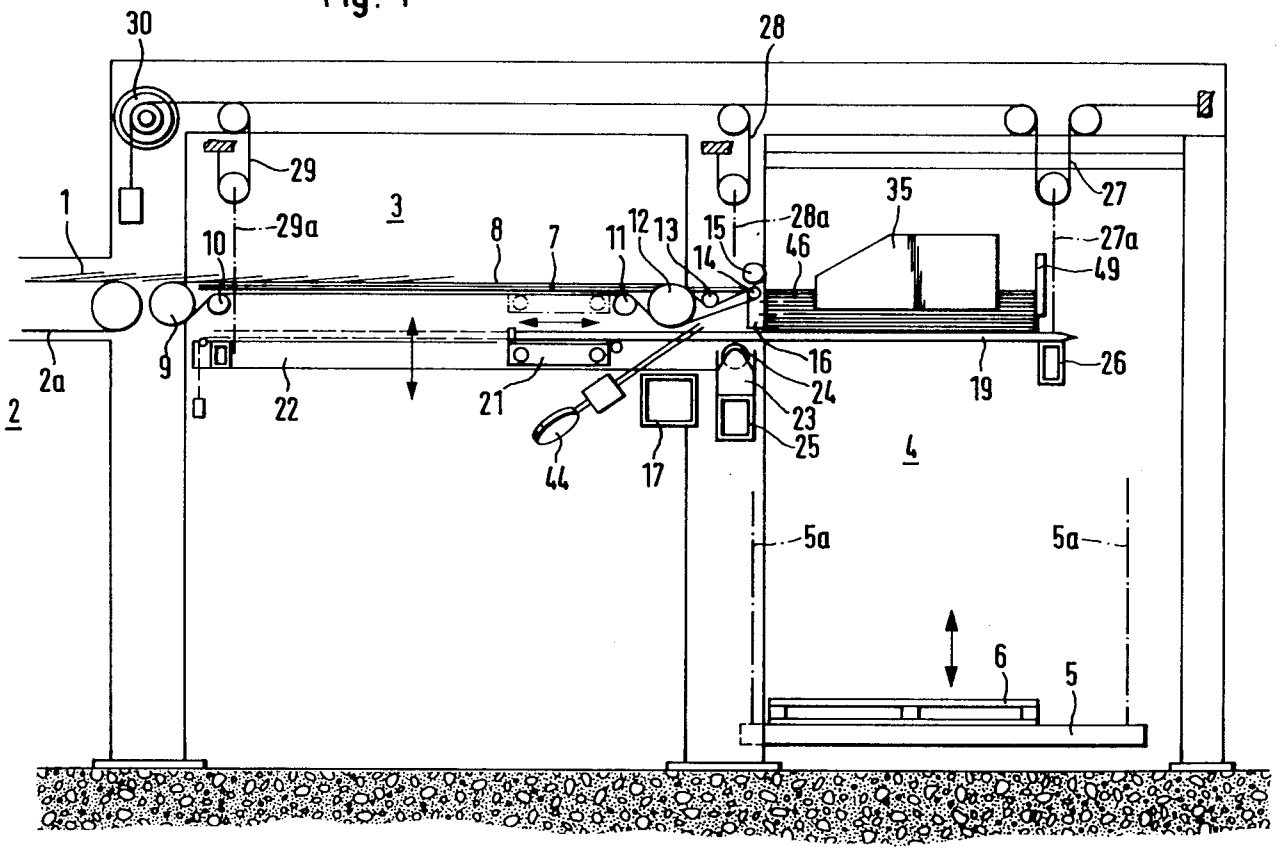
FIG. 1 shows a sheet stacker diagrammatically in side view.
Figure 2:
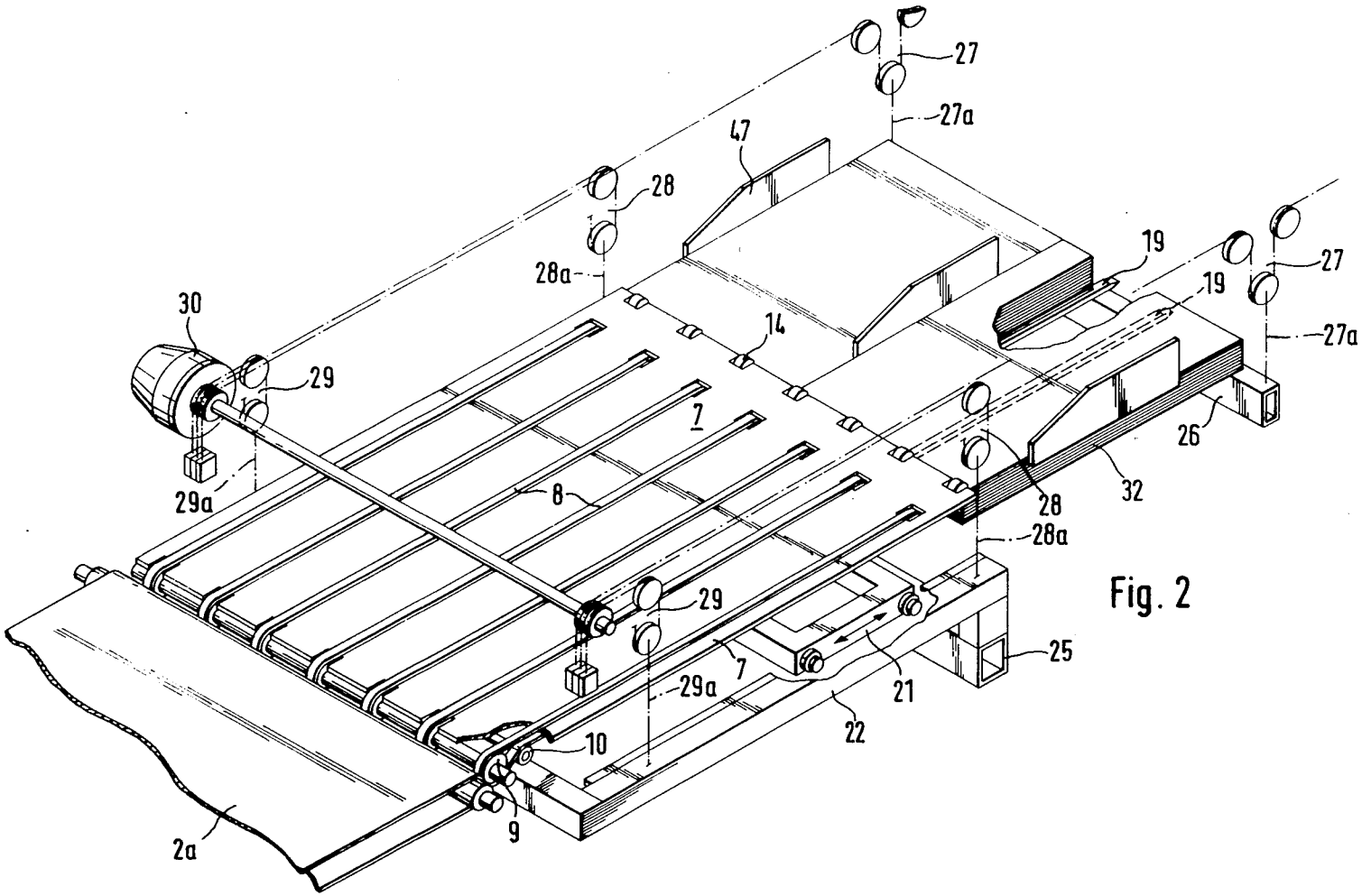
FIG. 2 shows the upper part of the sheet stacker according to FIG. 1, in perspective view.
Figure 4:
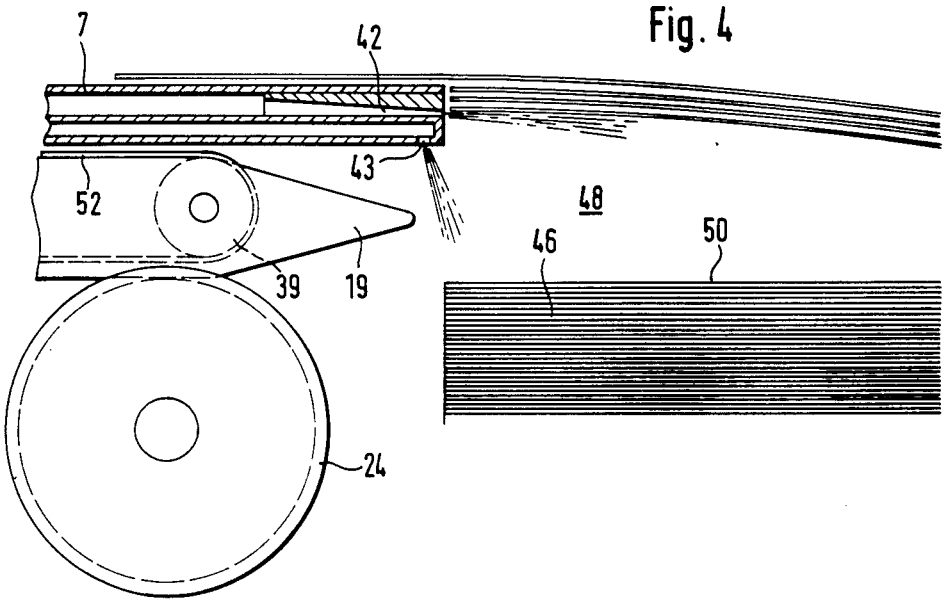
FIG. 4 shows part of the front edge of the transfer table of the sheet stacker according to FIG. 1, in vertical section beside a bar screen.
Figure 5:
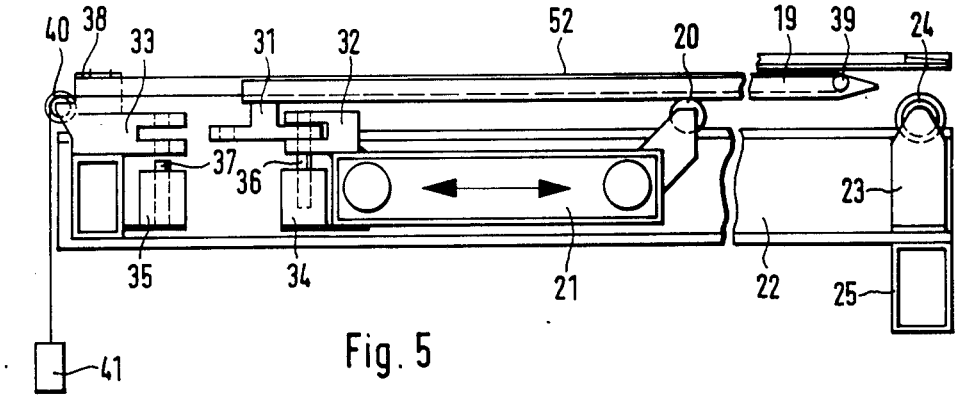
FIG. 5 shows a carriage for the bar screen able to travel in a guide which can be lowered, diagrammatically and in side view

The sheet stacker 4 consists of a table 5 which can be raised and lowered and is suspended from ropes 5*a* or the like, with a palette 6 placed thereon for the stack of sheets. In the illustration of FIG. 1, the stack has just been changed and a new palette 6 has been placed on the table 5.

The transfer table 3 consists of a thin, smooth table plate 7, on the upper side of which the upper belts of several narrow conveyor belts 8 are supported. The belts 8 are guided over several conveying, tensioning, guide and ejection rollers 9–14 located below the conveying plane. Apart from the rollers 9, all the rollers 10–14 are free-running. The rollers 9 are driven. The roller 14 at the front edge of the table plate 7 serves as an ejection roller. Together with a pressing roller 15 it ensures that the sheets are conveyed at a predetermined conveying speed as far as the stacker 4. The rollers 9–14 are mounted on narrow uprights 16, which also support the table plate 7, which are in turn supported on a cross member 17. Due to this particular guidance of the belts 8 and arrangement of the rollers 10–14, which can be seen in FIG. 1, front open free spacers 18 are provided between the uprights 16, which spacers reach as far as the underside of the table plate 7.

The bars 19 of a bar screen extend through these free spacers 18. These bars 19 of the bar screen are supported on track and support rollers 20 held on a carriage 21 and are detachably connected by their rear ends to the carriage 21, which is itself able to travel in guides 22 in the conveying direction of the sheets and in the opposite direction. In the region of the front edge of the table 7, the bars 19 are supported on support and track rollers 24 mounted in bearing blocks 23. The bearing blocks 23 are located on a cross member 25. A support 26 is provided for supporting the extended bars 19, on the side of the stacker 4 opposite the front edge of the table 7. The guide 22, the cross member 25 and the support 26 are suspended from ropes 27a, 28a, 29 of a common lifting device 27, 28, 29, which by means of a motor 30 allows the joint lowering and raising of the guide 22 and of the cross member 25 and the support 26.

At its rear end, each bar 19 of the bar screen comprises a coupling part 31 of T-shaped cross section, by which it can be connected positively either to a fork-like holder 32 of the carriage 21 or a fork-like holder 33 of the guide 22. Serving for coupling is an insertion pin 36, 37 able to be actuated respectively for example by an electromagnet 34, 35.

Each bar 19 is provided on its upper side with a sliding belt 52, whereof the upper side is attached by its rear end 38 to the guides 22 and at the free front end of the bar 19 is guided over a guide roller 39. The lower side of the sliding belt 52 is guided over a further guide roller 40 on the guide 22 and is loaded by a weight 41, which keeps the sliding belt 52 taut.

The front edge of the table plate 7 comprises two blowing nozzles 42, 43 in the region of the free spacers. The blowing air emerging from the slot-like blowing nozzle 42 in the conveying direction of the sheets acts as air lubrication and thus makes it easier for the sheets to be stacked to slide one over the other, whereas the compressed air emerging from the nozzle 43 presses the sheets quickly downwards and in this way creates the necessary free space 48 for the introduction of the bars 19. Whereas the blowing air leaves the slot nozzle 42 continuously, the compressed air leaves the nozzle 43 in pulses each time the rear edge of a sheet arrives in its range of action.

Due to the action of the blowing air on the sheets, not only is the separation of the sheets and counting of the sheets facilitated, but also the introduction of marking strips. For the introduction of marking strips, an interleaving device 44 for marking strips 45 may be provided in the free space 18 not required for a bar 19. In FIG. 3, the marking strip 45 placed in position by an interleaving device 44 is illustrated.

At the stacking point, both at the top as well as at the bottom, separating plates 47 and a stop board 49 extending above the upper level of the stack 46 are provided.

The operation of the afore-described sheet stacker will be described in detail hereafter in particular with reference to FIG. 6, *a–f*:

the sheets 1 conveyed in an overlapping manner are conveyed by the ejection rollers 14 and the pressure rollers 15 at a predetermined conveying speed virtually as far as the stop on the stop board 49. The air emerging from the slot-like nozzles 42 blows a film of air between the sheets, which film enables the sheets to slide one over the other. The separation of the individual sheets and the rapid pressing down of the individual sheets onto the stack 46 takes place by means of compressed air emerging in pulses from the nozzles 43.

The upper level 50 of the stack 46 lies a few centimeters below the conveying level (upper plane of the table plate 7), so that in this case a gusset 48 forms which is freely accessible from the rear edges of the sheet. The level 50 lies at least below the upper side of the bars 19 pointed at the front, as a rule even below the bars 19. Since the bars 19 in turn reach virtually to the underside of the table plate 7, the small free height of the gusset 48 is sufficient to be able to introduce the bars 19 between the overlapping sheets 1 and the stack 46. During this operation, which is illustrated in FIG. 6b, the stack 46 is lowered continuously, The bars 19 are lowered in synchronism therewith. The sliding belts 52 located on the upper side facilitate the insertion, so that the sheets are not damaged.

As soon as the bars 19 are completely inserted and supported by their front ends on the support 26, the stack 46 can be rapidly lowered and discharged. A new palette 6 is placed on the table plate 5, which is then raised up below the bars 19. Now the bars 19 can again be withdrawn, in which case they are supported with the weight on the palette 6 and their upper sliding belts 52 prevent the lower sheet of the stack formed thereon in the meantime from being damaged. After the palette 6 has entrained the new stack 46, the table plate 5 is lowered according to the supply of sheets, whereas the bars 19 again travel into their upper initial position (FIG. 6*a*).

Since no gaps need to be formed in the sheets 1 conveyed in an overlapping manner for this exchange of stack and thus the first sheet does not pass to an empty pallette, but to the bars 19 of the bar screen leaving sufficient space therebetween, the separating plates 47 can be arranged with their lower edges just below the upper level 50 of the stack 46, so that there is no danger that individual sheets dip below the lower edges of the separating plates 47.

It will be understood that the specification and examples are illustrative but not limitative of the present invention and that other embodiments within the spirit and scope of the invention will suggest themselves to those skilled in the art.

What is claimed is:

1. In a stacker for sheets such as paper, comprising a transfer table, means for conveying such sheets in overlapping manner to said transfer table, a stacking table to receive said sheets, means for raising and lowering said stacking table, means for conveying sheets from said transfer table to said stacking table along a conveying direction, a bar screen including a plurality of bars, and means for introducing the bar screen above the stacking table in the conveying direction between sheets which have already been stacked and sheets being conveyed to said stacking table, the improvement which comprises free spacers positioned below said transfer table, the free spacers receiving the bars of the bar screen at a level above the top of the stack on the stacking table, a first nozzle for blowing gas in the conveying direction of said sheets, said first nozzle being positioned adjacent the forward end of the transfer table below the level of supply, and a second nozzle for blowing gas, said second nozzle being positioned adjacent the forward end of the transfer table below the level of supply to blow gas downwardly toward the top of the stacked sheets, whereby the bar screen can be advanced to receive the new sheets for stacking while the stack therebelow is removed without reducing the conveying speeds.

2. A stacker according to claim 1, including a guide, means for lowering the guide, and a carriage capable of movement in the guide, the bars of the bar screen being arranged on said carriage.

3. A stacker according to claim 2, wherein the bars are removably arranged on said carriage.

4. A stacker according to claim 3, wherein each bar includes a twin coupling part, the stacker further including means for coupling the coupling part of each bar selectively to said carriage or said guide.

5. A stacker according to claim 1, including lateral separating and/or vibrating plates for the sheets and a stop for the front edges of the sheets arranged with their lower edges below the level of the upper side of the bars in the upper position of the bar screen.

6. A stacker according to claim 1, including a forward support for the forward ends of the bars when advanced, and means for raising and lowering said forward support.

7. A stacker according to claim 1, including a rear support for said bars, said rear support being positioned adjacent the space between the transfer table and stacking table, and means for raising and lowering said rear support.

8. A stacker according to claim 1, including means for continuously discharging gas through said first nozzle.

9. A stacker according to claim 1, including means for discharging gas through said second nozzle in pulses.

10. A stacker according to claim 1, including marking means positioned below the sheets on the transfer table and adjacent the forward end of the transfer table so as to introduce a marker between sheets as they are conveyed from the transfer table to the stacking table.

* * * * *